United States Patent [19]

Fukuda

[11] Patent Number: 4,902,172

[45] Date of Patent: Feb. 20, 1990

[54] MULTI-RODS TYPE APPARATUS FOR GROUND IMPROVEMENT

[75] Inventor: Kosei Fukuda, Yokohama, Japan

[73] Assignee: Tenox Corporation, Tokyo, Japan

[21] Appl. No.: 249,684

[22] Filed: Sep. 27, 1988

[30] Foreign Application Priority Data

May 26, 1988 [JP] Japan ..... 63-129298

[51] Int. Cl.[4] ..... E02D 3/12

[52] U.S. Cl. ..... 405/269; 405/263; 405/267

[58] Field of Search ..... 405/269, 267, 263, 258, 405/266, 223

[56] References Cited

FOREIGN PATENT DOCUMENTS 0131709 10/1981 Japan ..... 405/269

OTHER PUBLICATIONS

"The Soil Mixing Wall (SMW Technique)—Guidelines for its Design and Implementation", Japanese Material Institute, p.3, 3/86.

*Primary Examiner*—Dennis L. Taylor

*Attorney, Agent, or Firm*—Fleit, Jacobson, Cohn, Price, Holman & Stern

[57] ABSTRACT

This invention relates to a multi-rods type of ground improvement apparatus to be used in ground improvement work. There are provided plural rods in parallel, excavation blades are mounted to the ends of the rods, the rods are provided with injection openings for a solidifying agent, and at least one link arm is loosely mounted to connect the rods. Between the excavating blades and lowest positioned agitating blades, a still or stationary corotating prevention wing is loosely mounted and both ends of the wing are extended so as to be aligned with ends of the excavation blades positioned at opposite sides of the plural rods.

Clods dug by the excavation blades are fully crushed between the rotating excavation blades and the still or stationary corotation prevention wing and well mixed with the solidifying agent.

Further, by providing screw type of pilot heads at the ends of the rods, advancing of the rods into the ground is improved when the ground is excavated.

3 Claims, 1 Drawing Sheet

MULTI-RODS TYPE APPARATUS FOR GROUND IMPROVEMENT

BACKGROUND OF THE INVENTION

This invention relates to a multi-rods type apparatus for ground improvement.

PRIOR ART

For the ground improvement work wherein a solidifixing agent is injected to be mixed with soil by means of agitating, a multi-rods type ground improvement apparatus is conventionally used, wherein excavation blades are fixed respectively to each end portion of plural rods, plural steps of agitating blades are fixed to the rods above the upperside of the excavation blades and the rods are connected with a link arm so as to be held at a spaced interval and to prevent rotation of the axes of the rods.

However, in a case where the aforementioned apparatus is used for a soil layer such as silt and mud which are sticky, there will occur such a phenomon that the dug soil deposited by the excavation blades rotates in coincident with the agitating blades, namely a corotating phenomenon, due to the viscosity of the soil. Therefore it is impossible to fully crush the clods and to get the soil well mixed with the solidifying agent for obtaining a good quality of ground.

SUMMARY OF THE INVENTION

This invention achieves solving of the above described defects, and provides a first multi-rods type of ground improvement apparatus and a second multi-rods type of ground improvement apparatus which prevent dug soil from corotating, to obtain a good quality of ground improvement.

In a first multi-rods type of ground improvement apparatus according to this invention, wherein excavation blades are fixed and injection openings for a solidifying agent are provided on each end portion of plural rods, plural steps of agitating blades are fixed to the rods above the upperside of the excavation blades and the injection openings, and at least one link arm is loosely mounted to connect the rods, said improvement is characterized in that a stationary corotating prevention wing is loosely mounted and connected to each rod between the excavating blade and the lowest positioned agitating blade, and both ends of the corotating prevention wing are extended in opposite directions from each center of each rod and from respective opposite sides of said plural rods such that each extended end of the corotating prevention wing is arranged to be the same length as that of the radius of the respective excavating blade (the length of the excavating blade plus the radius length of the rod).

Further, in a second multi-rods type of ground improvement apparatus, wherein pilot-heads are fixed respectively to the tip ends of plural rods, excavation blades are fixed to the rods and the rods are provided with injection openings for solidifier on an upper portion thereof, plural steps of agitating blades are fixed to the rods above the upperside of the excavation blades, and at least one link arm is loosely mounted to connect the rods said improvement is characterized in that a stationary corotating prevention wing is loosely mounted between the excavation blades and the lowest positioned agitating blades to connect the rods, both ends of the corotating prevention wing are extended in opposite directions from each center of each rod and from respective opposite sides of said plural rods such that each extended end of the corotating prevention wing is arranged to be the same length as that of the radius of the respective excavating blade (the length of the excavating blade plus the radius length of the rod).

Clods dug by the rotating and advancing excavation blades can be fully crushed between the excavation blades and the corotating prevention wing because the corotating prevention wing is kept still or stationary while the excavation blades are rotating. After that, the resultant crushed soil is further stirred by the agitating blades and sufficiently mixed with the solidifying agent.

DETAILED DESCRIPTION OF THE INVENTION

Now, referring to the attached drawings, the disclosed enbodiments of this invention will be described.

Figure 1:
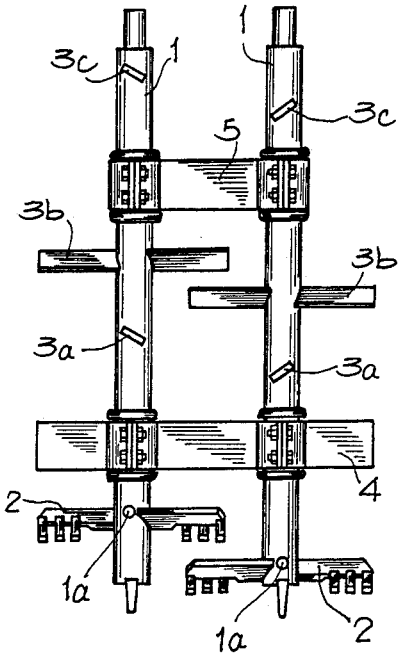
FIG. 1 is a front view for showing an embodiment according to the present invention and FIG. 2 is a front view for showing another embodiment according to the present invention.

FIG. 1 shows an embodiment of this invention, which is a two rods type apparatus for ground improvement. However, the number of rods is not limited to this type and more than two rods may be utilizable. In this embodiment, excavation blades 2 are fixed at the end portions of the two rods 1 and plural steps (three steps in the drawings) of agitating blades **3*a*, 3*b* and 3*c* are fixed is the rods above the upperside of the excavation blades 2. A single corotating prevention wing 4 is loosely mounted between each excavation blade 2 and each of the lowest agitating blades 3a to connect the rods 1. Both ends of the corotating prevention wing 4 are extended in opposite directions from each center of each rod 1 and from respective opposite sides of among said plural rods such that each extended end of the corotating prevention wing is arranged to be the same length as that of the radius of the excavating blade 2 (the length of the excavating blade plus the radius length of the rod). If both extended ends of the corotating prevention wing are longer than those of the excavation blades 2 each, end of the corotating prevention wing will collide with the side wall of the ground which is not excavated so that the excavating blades can not further advance into the earth. However, if the ends of the corotating prevention wing 4 are shorter than those of the excavation blades 2, clods excavated will run off through the ends of the corotating prevention wing and the ground side wall and will not be able to be fully crushed. Thus, in the ground improvement apparatus of this invention, the ends of the corotating prevention wing 4 are arranged to be equal with those of the excavation blades 2 fixed to both sides of the plural rods 1. Further, a link arm 5 is loosely mounted on the upperside of the corotating prevention wing 4, between the agitating blades 3*b* and 3*c* to connect the rods 1**.

As described hereinafter, the corotating prevention wing 4 is kept still or stationary even if the rod 1 rotates, thereby preventing soil from corotating with the rod. The corotating prevention wing 4 also serves like the link arm 5 to hold the rods 1 to be spaced at a given interval together with preventing the axes of the rods from rotation. Further, there are provided injection openings 1a in the rods 1 in the vicinity of the excavation blades 2 fixed to each rod 1 (e.g., between the blades as shown in FIG. 1).

In use of the above mentioned apparatus according to this invention, clods excavated by the rotating and advancing excavation blades 2 are fully crushed between the excavation blades 2 because the corotating prevention wing 4 is kept still or stationary while the excavation blades 2 are rotating and the solidifying agent is injected from the injection openings 1a near the excavation blades 2. Thus, clods are prevented from rotating and the resultant crushed soil is further stirred by the agitating blades 3a, 3b and 3c, which are also rotating, and sufficiently mixed with solidifier the solidifying agent.

Figure 2:
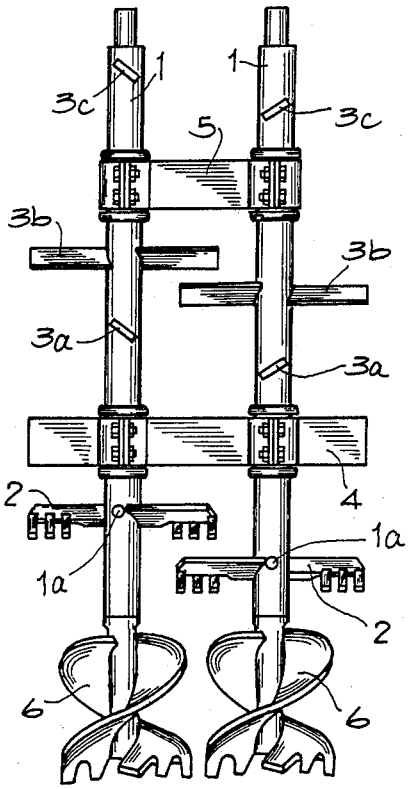

FIG. 2 shows another embodiment of this invention wherein pilot heads 6 are mounted to the tip ends of the rods 1 as shown in the ground improvement apparatus in FIG. 1. However, a ground improvement apparatus with three(3) or more rods may be applicable used.

By using the pilot head 6, excavating power can be improved and it enables smooth advancing into the ground. Other construction and effects are the same as described referring to FIG. 1. Therefore, the same numeral designates the same portion as in FIG. 1 and the description will be omitted.

As described above, clods dug by the excating blades 2 (or the pilot heads 6 in the second embodiment of this invention) are crushed between the corotating prevention wing 4 and the excavating blades, which are rotating so that soil is fully mixed and a good ground improvement is obtained. Further, since corotating prevention wing 4 also serves as a link arm, the number of the link arms 5 can be reduced.

What is claimed is:

1. A multi-rods type of ground improvement apparatus wherein excavation blades are fixed to and injection openings for a solidifying agent are provided on end portions of respective plural rotatable rods, plural steps of agitating blades are fixed to respective ones of said rods above an upperside of said excavation blades and said injection openings, at least one link arm is loosely mounted to connect said rods, a stationary corotating prevention wing is loosely mounted on said rods between said excavation blades and a lowest positioned one of said agitating blades to connect said rods, and opposite end portions of said stationary corotating prevention wing are extended in opposite directions from a center of an adjacent one of said rods such that each extended end portion of said corotating prevention wing is the same length as a radius of the excavation blade therebeneath, so that said stationary corotating prevention wing prevents rotation of soil clods with said rotating excavation blades, without outer ends of said stationary corotating prevention wing colliding with a side wall of the ground being excavated, and without soil clods running off through the wing outer ends and the ground side wall, whereby said stationary corotating prevention wing and said excavation blades cause full crushing of the soil clods for mixing of the excavated soil with the solidifying agent by the agitating blades.

2. A multi-rods type of ground improvement apparatus as recited in claim 1, wherein pilot-heads are fixed respectively to each tip end of each of the plural rods below the excavation blades on the rods, to improve excavating power and enable smooth advancing into the ground.

3. A multi-rods type of ground improvement apparatus as recited in claim 1, wherein said injection openings are provided in said rods between respective ones of said excavation blades on said rods.

* * * * *